US011766121B2

(12) United States Patent
Tooley

(10) Patent No.: US 11,766,121 B2
(45) Date of Patent: Sep. 26, 2023

(54) MOUNTING APPARATUS

(71) Applicant: Norcros Group (Holdings) Limited, Hampshire (GB)

(72) Inventor: Jonathan Harry Tooley, Hampshire (GB)

(73) Assignee: Norcros Group (Holdings) Limited, Hampshire (GB)

( * ) Notice: Subject to any disclaimer, the term of this patent is extended or adjusted under 35 U.S.C. 154(b) by 0 days.

(21) Appl. No.: 17/624,636

(22) PCT Filed: Jul. 2, 2020

(86) PCT No.: PCT/GB2020/051585
§ 371 (c)(1),
(2) Date: Jan. 4, 2022

(87) PCT Pub. No.: WO2021/001652
PCT Pub. Date: Jan. 7, 2021

(65) Prior Publication Data

US 2022/0257014 A1 Aug. 18, 2022

(30) Foreign Application Priority Data

Jul. 4, 2019 (GB) ..... 1909623

(51) Int. Cl.
*A47B 95/00* (2006.01)
*A47B 96/07* (2006.01)
*A47B 96/06* (2006.01)

(52) U.S. Cl.
CPC ..... *A47B 95/008* (2013.01); *A47B 96/07* (2013.01); *A47B 96/066* (2013.01)

(58) Field of Classification Search
CPC ..... A47B 95/00; A47B 95/008; A47B 96/06; A47B 96/066
See application file for complete search history.

(56) References Cited

U.S. PATENT DOCUMENTS 4,457,436 A * 7/1984 Kelley ..... A47B 95/008 312/246
6,357,716 B1 * 3/2002 Kratish ..... A47G 1/205 40/713

(Continued)

FOREIGN PATENT DOCUMENTS

DE 2923230 A1 * 12/1980 ..... A47B 95/008
DE 3033024 A1 * 3/1981 ..... A47B 95/008

(Continued)

OTHER PUBLICATIONS

UK Search Report dated Nov. 20, 2019, International Application GB1909623.9.

(Continued)

*Primary Examiner* — Andrew M Roersma
(74) *Attorney, Agent, or Firm* — DINSMORE & SHOHL LLP

(57) ABSTRACT

The invention provides apparatus for mounting a furniture unit to a wall and, in particular, to wall studs. The apparatus includes sliding fixings that allow the spacing between fixing members to be adjusted and, thereby, allow the horizontal position of the furniture unit to adjusted to any desired position relative to the wall studs.

8 Claims, 2 Drawing Sheets

(56) References Cited

U.S. PATENT DOCUMENTS

| | | | | |
|---|---|---|---|---|
| 7,708,252 | B2 * | 5/2010 | Vander Berg | A47G 1/1606 248/475.1 |
| 9,133,979 | B2 * | 9/2015 | Dewaele | A47G 1/1686 |
| 2002/0125389 | A1 * | 9/2002 | Chu | A47G 1/1606 248/235 |
| 2018/0235366 | A1 | 8/2018 | Pyle et al. | |
| 2019/0003637 | A1 | 1/2019 | Ostera | |

FOREIGN PATENT DOCUMENTS

| | | | | |
|---|---|---|---|---|
| DE | 3104541 | A1 * | 8/1985 | A47B 95/008 |
| DE | 202009009196 | U1 * | 12/2009 | A47B 57/52 |
| FR | 2276019 | A1 * | 1/1976 | A47B 95/008 |
| GB | 2427119 | A | 12/2006 | |
| KR | 1020120099885 | A * | 9/2012 | A47B 96/06 |
| WO | WO-2012034673 | A1 * | 3/2012 | A47B 95/008 |

OTHER PUBLICATIONS

International Search Report dated Aug. 24, 2020; International Application PCT/GB2020/051585.

* cited by examiner

MOUNTING APPARATUS

CROSS-REFERENCE TO RELATED APPLICATIONS

This application is the U.S. National Stage of PCT/GB2020/051585 filed Jul. 2, 2020, which claims priority to United Kingdom Patent Application No. 1909623.9 filed Jul. 4, 2019, the content of both of which are incorporated herein by reference in their entirety.

FIELD OF THE INVENTION

This invention relates to an apparatus for mounting furniture on a substantially vertical surface such as a wall. In this context 'furniture' should be interpreted as including (but not necessarily be restricted to) cupboards, shelves, mirrors, and brackets on or with which other components may be mounted or engaged.

BACKGROUND TO THE INVENTION

In our British Patent GB2427119 we describe and claim apparatus for mounting and levelling furniture on a vertical wall surface. Whilst the arrangement described is simple to use, it is relatively costly to manufacture. Further, the level must be established before the furniture item is placed into position on the wall and the horizontal spacing between the fixings that attach the apparatus to the wall, is substantially fixed. This latter feature limits the positioning of heavier components to walls that require the apparatus to be fixed through the wall and into spaced vertical studs supporting the wall.

It is an object of the invention to provide apparatus that will go at least some way in addressing the drawbacks mentioned above; or which will at least provide a novel and useful alternative.

SUMMARY OF THE INVENTION

Accordingly, in a first aspect, the invention provides mounting apparatus including an engagement facility configured to engage an item of furniture to mounted; and a plurality of fixings, each fixing being configured to receive a fastener whereby the apparatus may be fixed to a wall, wherein said apparatus includes connecting means connecting said fixings along a connection axis, said connecting means and said fixings being configured such that a fixing can be located with respect to another at substantially any position along said connecting axis.

Preferably said engagement facility comprises a substantially continuous surface extending substantially parallel to said connection axis.

Preferably said engagement facility is included in said connecting means.

Preferably, when mounted in a functioning position, said engagement facility defines or is included in an upper boundary of said apparatus.

Preferably said connecting means includes a pair of spaced, facing, channels extending in the direction of said connection axis, and wherein at least one of said fixings includes lugs engageable within said channels, said channels and said lugs being configured so that said at least one of said fixings is retained within but is slidable along said channels.

Preferably a surface of each of said fixings and a surface of said connecting means lie in a substantially common surface contact plane.

Preferably said mounting apparatus further includes end fittings engageable with spaced ends of said connecting means, said end fittings being configured to mount and retain a nail or screw aligned along a fastening axis that is at an acute angle to said surface contact plane.

Preferably said apparatus is configured so that the distance between two fixings can be adjusted between substantially 0 inches and at least 16 inches.

Many variations in the way the present invention can be performed will present themselves to those skilled in the art. The description which follows describes one or more examples only of combinations of elements or components for performing the invention. Within the limits of the appended claims one, more or all of the described elements could be substituted to provide an embodiment of the invention and the invention is not to be confined to the combinations, whether in whole or in part, to those described.

BRIEF DESCRIPTION OF THE DRAWINGS

One working embodiment of the invention will now be described with reference to the accompanying drawings in which.

DETAILED DESCRIPTION OF WORKING EMBODIMENT

Figure 1:
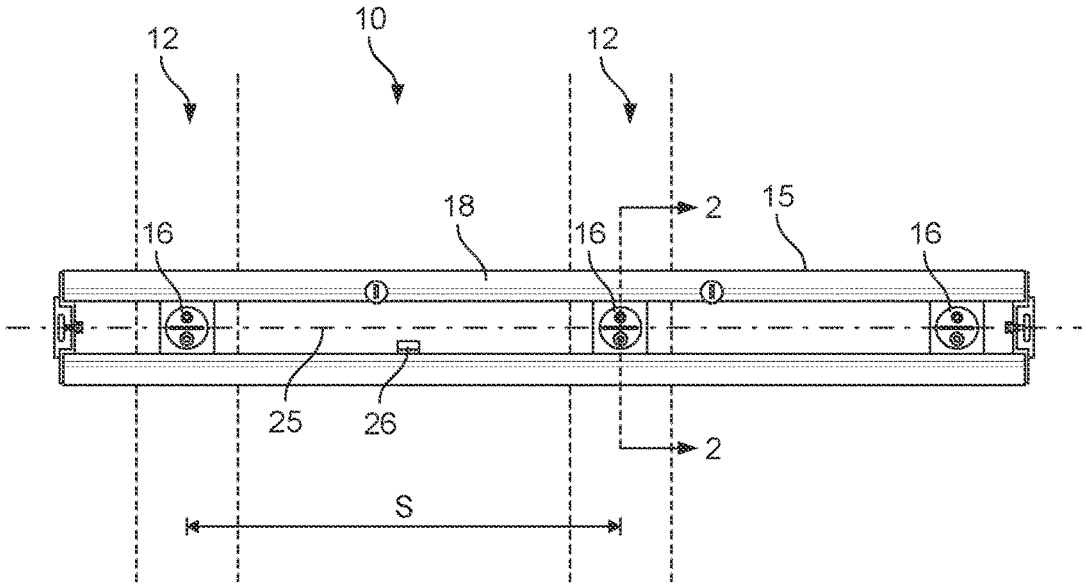
FIG. 1: shows a front elevational view of mounting apparatus according to the invention in a position of use.

As shown in the Figures, furniture mounting apparatus 10 is provided that is not restricted to, but is particularly suited for, mounting an item of furniture (not shown) against a vertical wall surface 11 supported on spaced vertical studs 12. As used herein the term 'item of furniture' should be interpreted in its broadest sense and to include (but not necessarily be restricted to) cupboards, cabinets, shelves and brackets for suspending other units.

According to accepted building practice, the studs 12 have a horizontal centre-to-centre spacing of S. In the UK S is generally 16 inches but other countries may specify a different value for S. It is generally desirable, and in certain cases essential, that the furniture unit be supported on at least two studs. In the example illustrated, the apparatus 10 is configured for fixing to two studs but it will become apparent from the following description that the apparatus could be configured for fixing to a greater number of studs at the same or different spacings, or indeed other mounting points, depending on the mass and/or width of the furniture item to be mounted using the apparatus.

The apparatus 10 comprises engagement means configured to support the furniture unit which, in this particular case, comprises a mounting surface 15 preferably extending the length of the apparatus. Fixings 16 are provided which, in use, are fixed through the wall and into studs 12 by screws 17 or the like and connecting means 18 are provided to locate the fixings 16 relative to one another so that the apparatus 10 can be mounted and fixed to the wall 11 accurately and efficiently.

The mounting surface 15 is conveniently incorporated in the connecting means and, in particular, by a surface of the connecting means which, when mounted, is upwardly facing, so that the furniture unit is supported on the mounting apparatus under gravity. It can be seen, particularly in FIG. 2, that, when the apparatus is mounted against a wall 11, the upper and lower side edges 19 of the apparatus are angled inwardly at acute angles to the wall 11. This helps to bias the furniture unit against the wall 11.

In this example, the connecting means is provided by two spaced parallel members 20 that are configured to retain the fixings 16 therebetween. The members 20 are preferably identical extrusions that are arranged in mirror fashion. The extrusions have channels 22 which face one another and are configured to receive lugs 23 provided on opposite edges of the fixings 16. The lugs may, as shown, comprise lateral channels which are configured, along with channels 22, so that the fixings 16 can be slidably positioned along a connection axis 25. This is a particular feature of the invention that allows fixings to be positioned relative to one another at any position along connection axis 25, from being in close contact to each being positioned adjacent to an opposite end of the connecting means. It is thus envisaged that the distance between two adjacent fixings could be adjusted from being substantially 0 inches apart (or touching) to at least 16 inches apart. However, these figures should not be regarded as limiting as the lengths of members 20, and the number of fixings, can be set or selected to address any particular mounting requirement. By way of further example, it is preferred that the width of the apparatus be set substantially to the width of the furniture item being supported and thus the width of the apparatus is conveniently set at 48 inches for mounting a bathroom cabinet of 48 inches in width.

The channels 22 and lugs 23 are preferably sized so that, while the lugs can slide within the channels 22 there is a degree of frictional resistance that prevents free or uncontrolled sliding movement.

One of channels 22, preferably that on the lower member 20, may also serve to mount a spirit level holder 26 and the members 20 preferably further include fixing channels 27, each configured and sized to receive the t-shaped head 28 of a unit retainer 29.

The fixings 16 preferably operate in substantially the same manner as described in British patent GB2427119 and comprise a rectangular body 30 on which channels 23 are arranged on opposite edges. Each body 30 has a stepped aperture 31 extending centrally therethrough that, in use, receives a correspondingly stepped disc 32. The disc 32 includes mounting holes 33 that are offset from the geometric centre of the disc, one of the holes 33, in use, receiving a fixing screw 17. As a result, when the disc is pinned in position by a mounting screw 17, rotation of the disc 32 in the aperture 31, about screw 17, creates a cam-like action that, as described below, can be used to adjust the level of the apparatus.

Figure 2:
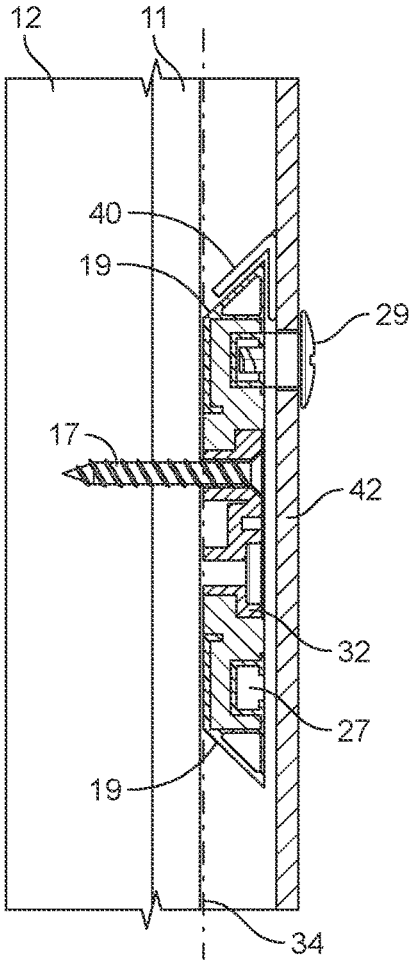
FIG. 2: shows, in a larger scale, a view along the section 2-2 in FIG. 1.
Figure 3:
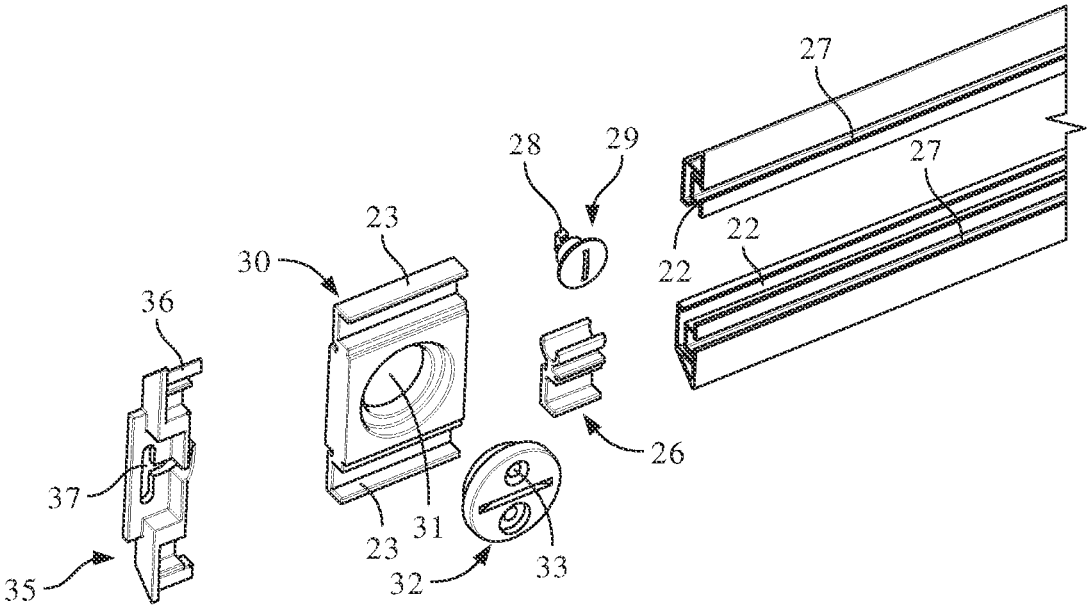
FIG. 3: shows an exploded isometric view of the components comprised in the mounting apparatus shown in FIGS. 1 & 2.

It will be seen from FIG. 2 that, when the discs 32 are located in apertures 31 and the fixings 16 are fitted to extrusions 20, the surface parts of all the components on that side on the apparatus that contacts the wall 11 lie in a substantially common surface contact plane 34.

Figure 4:
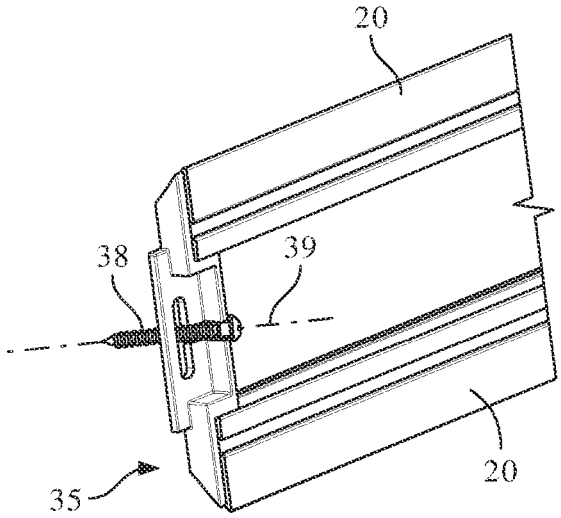
FIG. 4: shows a detailed view of an end fitting comprised in the mounting apparatus.

The apparatus 10 may further include one or more end fittings 35 that include end spigots 36 configured to lock into the ends of members 20 as shown in FIG. 4. The end fittings are preferably formed with a socket 37 that positions and supports additional end nails or screws 38 while being driven along a fastening axis 39 that is at an acute angle to the surface contact plane 34 but it can be seen that the same end fitting also allows the screws 38 to be applied perpendicular to the plane 34.

The apparatus described above is used in the following matter:

The positions of at least two spaced wall studs 12, to which the furniture unit is to be fixed, are identified and the apparatus 10 is offered up against the wall surface 11 overlying those studs; and in the desired position in which the unit is to be fixed. The relative positions of fixings 16 are then adjusted by sliding one or both fixings within members 20 so that one fixing 16 overlies one stud and another fixing overlies another, horizontally spaced, stud. Using a spirit level retained in holder 26, the apparatus is levelled and the fixings 16 then loosely fastened into position by screws 17. At this stage, the level can again be checked and, if the apparatus has gone out of level in the fixing process, level can again be achieved by rotating one or both of discs 32 within bodies 30. Once level is again established the members 20 may be slid relative to the fixings, to the left or to the right, until the apparatus is located in the desired position. The screws 17 may be driven firmly home and, if desired, further locking screws applied through the additional holes in discs 30.

Supplementary fixings may also be applied using screws passed through end caps 35.

With the mounting apparatus firmly located in the desired position on the wall 11, the furniture unit may be hung thereon. To this end a hanging bracket 40 may be applied to a backboard 42 of the furniture unit and holes may be formed in the backboard so that retainers 29 may be passed through the backboard and turned through 90° until the t-shaped heads 28 lock within channels 27 to securely hold the unit in position.

It will thus be appreciated that the invention, at least in the case of the particular embodiments described, provides effective forms of apparatus that allow persons of limited skill to effectively and accurately mount furniture items on stud walls while offering more skilled people apparatus that can substantially reduce the time required to perform such tasks.

The invention claimed is:

1. A mounting apparatus, comprising:

an engagement facility configured to engage an item of furniture to be mounted;

two elongated members disposed spaced apart from each other in a parallel relationship, a longitudinal dimension of said elongated members defining a connection axis, each said elongated member having a channel therealong such that the channel of one of said elongated members faces the channel of the other one of said elongated members;

a plurality of fixings holding said elongated members in the spaced apart relationship, each said fixing being configured to be fixed to a wall, said plurality of fixings disposed between said elongated members and retained in said channels, at least one of said fixings being slidable along said channels, a respective position between said fixings being changeable along said connecting axis; and a fastener configured to be inserted through one of said fixings and into a wall.

2. The mounting apparatus according to claim 1, wherein said engagement facility comprises a substantially continuous surface extending substantially parallel to said connection axis.

3. The mounting apparatus according to claim 1, wherein said engagement facility is included in said elongated members.

4. The mounting apparatus according to claim 1, wherein mounted in a functioning position, said engagement facility defines or is included in an upper boundary of said apparatus.

5. The mounting apparatus according to claim 1, wherein at least one of said fixings includes lugs engageable within said channels, said channels and said lugs being configured so that said at least one of said fixings is retained within but are slidable along said channels.

6. The mounting apparatus according to claim 1, wherein a surface of each of said fixings and a surface of each of said elongated members lie in a substantially common wall surface contact plane.

7. The mounting apparatus according to claim 6, further including end fittings engageable with spaced ends of said elongated members, said end fittings being configured to mount and retain a nail or screw aligned along a fastening axis that is at an acute angle to said wall surface contact plane.

8. The mounting apparatus according to claim 1, wherein said apparatus is configured so that a distance between two said fixings is adjusted between substantially 0 inches and at least 16 inches.

* * * * *